US005314253A

United States Patent [19]

Grass, Jr.

[11] Patent Number: 5,314,253

[45] Date of Patent: May 24, 1994

[54] ROLLING ELEMENT GUIDE FOR DRAWER GUIDES

[75] Inventor: Alfred Grass, Jr., Hochst/Vlbg., Austria

[73] Assignee: Grass AG, Hochst/Vlbg., Austria

[21] Appl. No.: 15,625

[22] Filed: Feb. 9, 1993

[30] Foreign Application Priority Data

Feb. 12, 1992 [DE] Fed. Rep. of Germany ..... 4204067

[51] Int. Cl.[5] ..... A47B 88/00; F16C 29/04

[52] U.S. Cl. ..... 384/19; 384/47

[58] Field of Search ..... 384/19, 47, 50, 51, 384/56, 58

[56] References Cited

U.S. PATENT DOCUMENTS

| | | | |
|---|---|---|---|
| 1,112,900 | 10/1914 | Etheridge | 384/47 |
| 2,799,541 | 7/1957 | Wolters | 384/19 |
| 4,445,726 | 5/1984 | Röck et al. | 384/19 |
| 4,598,957 | 7/1986 | Shibayama | 384/51 |
| 4,697,934 | 10/1987 | Hölzle | 384/19 |
| 5,022,768 | 6/1991 | Baxter | 384/19 |

*Primary Examiner*—Thomas R. Hannon

[57] ABSTRACT

A rolling element guide for drawer guides consists of a furniture unit body rail mounted on the furniture unit body side wall and a drawer rail mounted on the drawer, rolling surfaces for the rolling elements transmitting the drawer load being arranged on both rails, the rolling elements being held in a roller cage arranged between the rails. For minimizing the rolling noise and for reducing the manufacturing costs, the rolling elements have pins on opposing end faces, these pins pivoting in the roller cage, the pins of rolling elements arranged in the same plane being staggered 90 degrees with respect to each other, which forms rolling surfaces on the rolling elements that are staggered 90 degrees with respect to each other, and high drawer loads can be transmitted.

8 Claims, 6 Drawing Sheets

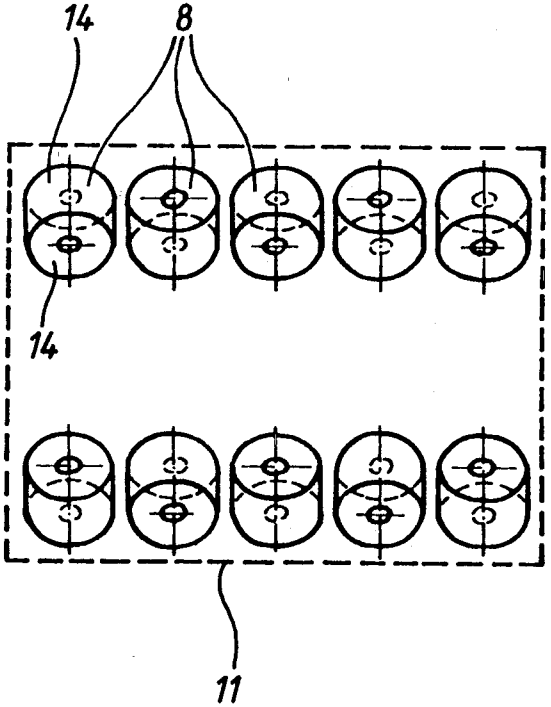
FIG 6
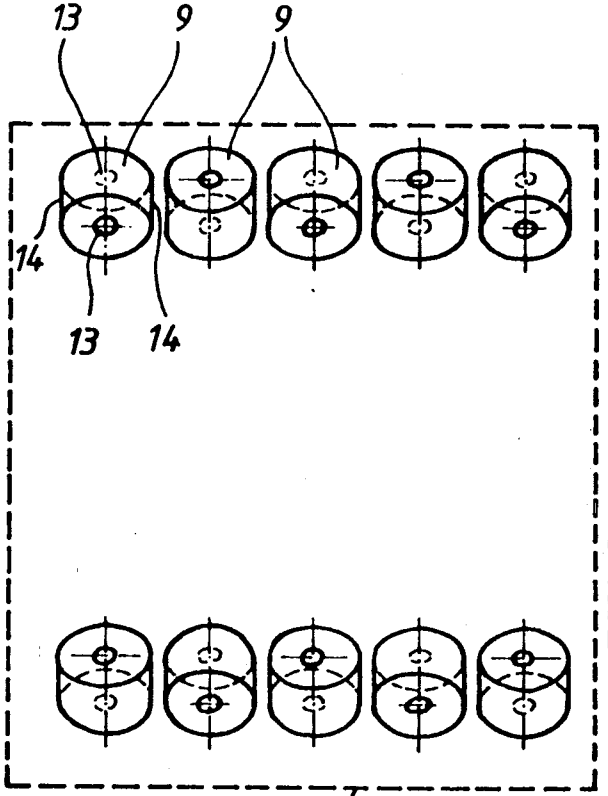
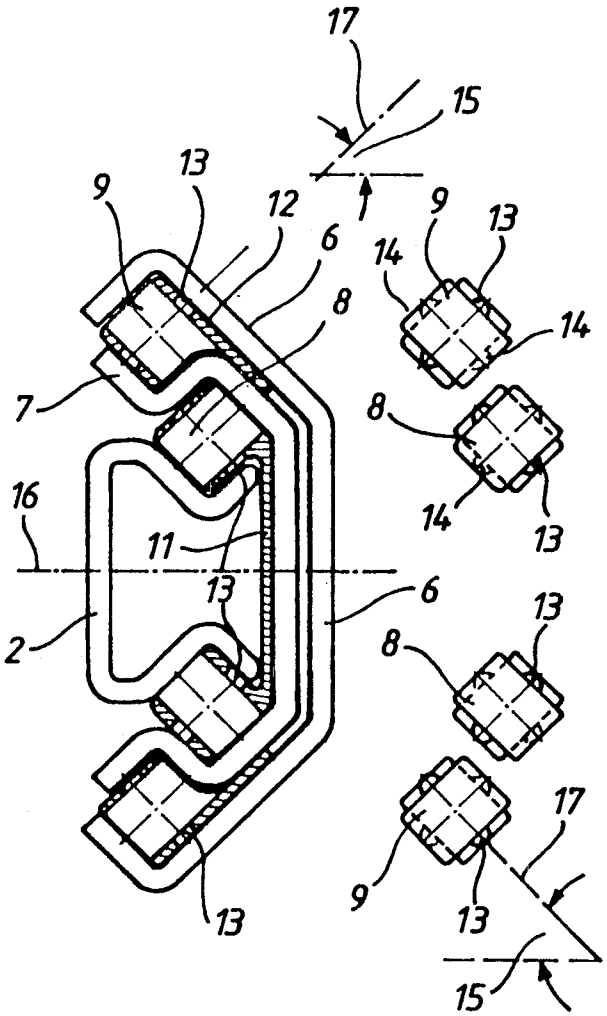
FIG 5
FIG 4

ROLLING ELEMENT GUIDE FOR DRAWER GUIDES

BACKGROUND OF THE INVENTION

The invention relates to a rolling element guide for drawer guides in accordance with the introductory part of claim 1. This kind of rolling element guide has been disclosed in German patent document 2 721,231, for example. It involves a double pull-out device in which an intermediate rail is also guided telescope-fashion in the space between a furniture unit body rail and a drawer rail. The rolling elements used are spheres which pivot in a suitable roller cage and transmit the drawer load from the drawer to the furniture unit rail.

The drawback in the use of rollers as rolling elements is the difficulty in making the rollers round enough to minimize the rolling noise. The disadvantage in the use of rollers is that relatively loud rolling noise must be expected. Furthermore, mounting the rollers in suitable pocket-like recesses in the roller cage is relatively complicated and leads to high costs for manufacturing the roller cage.

SUMMARY OF THE INVENTION

The object of the invention is to develop a rolling element guide of the type mentioned at the outset so that less rolling noise is ensured with lower costs for manufacturing the guide.

This object is achieved by the invention through the technical instruction of claim 1.

The feature of the invention is that, instead of the freely guided rollers according to the state of the art, use is now made of the invented rolling elements according to the invention, which have pins on opposing end faces with which they pivot in the associated roller cage.

The pin bearing of such rolling elements in a roller cage considerably reduces the manufacturing costs of the roller cage because it is no longer necessary to have pocket-like recesses for freely guided rollers, now only pin bores have to be provided for engagement of corresponding pins of the rolling elements.

The use of pin-guided rolling elements has the further benefit that the rolling elements now roll on defined rolling surfaces and it is now no longer necessary, as in the case with spheres, to machine all sides of the rolling element with the attendant high cost.

According to the invention, machining is thus needed only on the sides of the rolling elements having rolling surfaces, while the end faces of the rolling elements bearing the pins do not require such expensive machining because they do not form any rolling surfaces with the associated rail-side rolling surfaces.

According to the invention, rolling elements in general with pins arranged thereon are required. The concept of rolling element includes both a roll or a roller, and the roller can be a cylindrical roller, a spherical roller or a needle. The common feature of all rolling elements is that they have pins on opposing end faces, and the rolling surfaces vertical thereto can be straight, arched or contoured according to the instruction given above.

A further important feature of the technical instruction of claim 1 is that the pins of rolling elements in the same plane are staggered 90 degrees with respect to each other. The concept "arranged in the same plane", is not to be considered as limiting. In the design of a rolling element guide with rolling elements arranged vertically with respect to each other, the phase "in the same plane" means a vertical plane, and the phrase "same plane" refers to those rolling elements which are in the same plane relative to the longitudinal extension of the roller cage. That is, the rolling elements of a roller cage are in the same plane when the two together form the most forward rolling element, for example. The rolling elements are thus always arranged by pairs, top and bottom, in the roller cage, and the rolling elements paired with each other are staggered with their pins 90 degrees with respect to each other according to the instruction of the invention. The pin of the bottom rolling element, for example, is arranged and reversed where the rolling surface of the top rolling element is located.

The phrase "in the same plane" does not refer only to paired rolling elements arranged vertically one over the other, it also refers to paired rolling elements arranged next to one another in the horizontal plane for which the same technical instruction applies.

The staggering of the rolling surfaces by 90 degrees of associated (paired) rolling elements in a roller cage results in the material advantage that there is now lateral stability toward all sides, and thus high drawer loads can be transmitted through the associated drawer rail to the furniture unit body rail.

Such rolling element guides can also cooperate with a so-called automatic draw-in system. With this kind of automatic draw-in system that is part of the art, the drawer can be pushed into the furniture unit body, overcoming a slight resistance to rolling in the last part of push-in travel of the drawer in a furniture unit body rail, and then it travels the rest of the way automatically.

The subject-matter of the present invention arises not only from the subject-matter of the individual patent claims, but rather also from a combination of the individual patent claims with each other. All data and features disclosed in the documents, including the abstract, particularly the spatial arrangement shown in the drawings, are claimed as essential to the invention to the extent they are new compared to the art either individually or in combination.

The invention is explained in more detail below using the drawings representing only one embodiment. Further features essential to the invention and advantages of the invention will be seen in the drawings and their description.

BRIEF DESCRIPTION OF THE DRAWINGS

FIG. 4 is an enlarged detail drawing corresponding to the guide according to FIG. 1.

FIG. 5 shows the rolling elements of FIG. 4 as installed in the associated roller cages.

FIG. 6 shows the installed position of the rolling elements according to FIGS. 4 and 5 in an outer and in an inner roller cage.

DESCRIPTION OF THE PREFERRED EMBODIMENT

Figure 1:
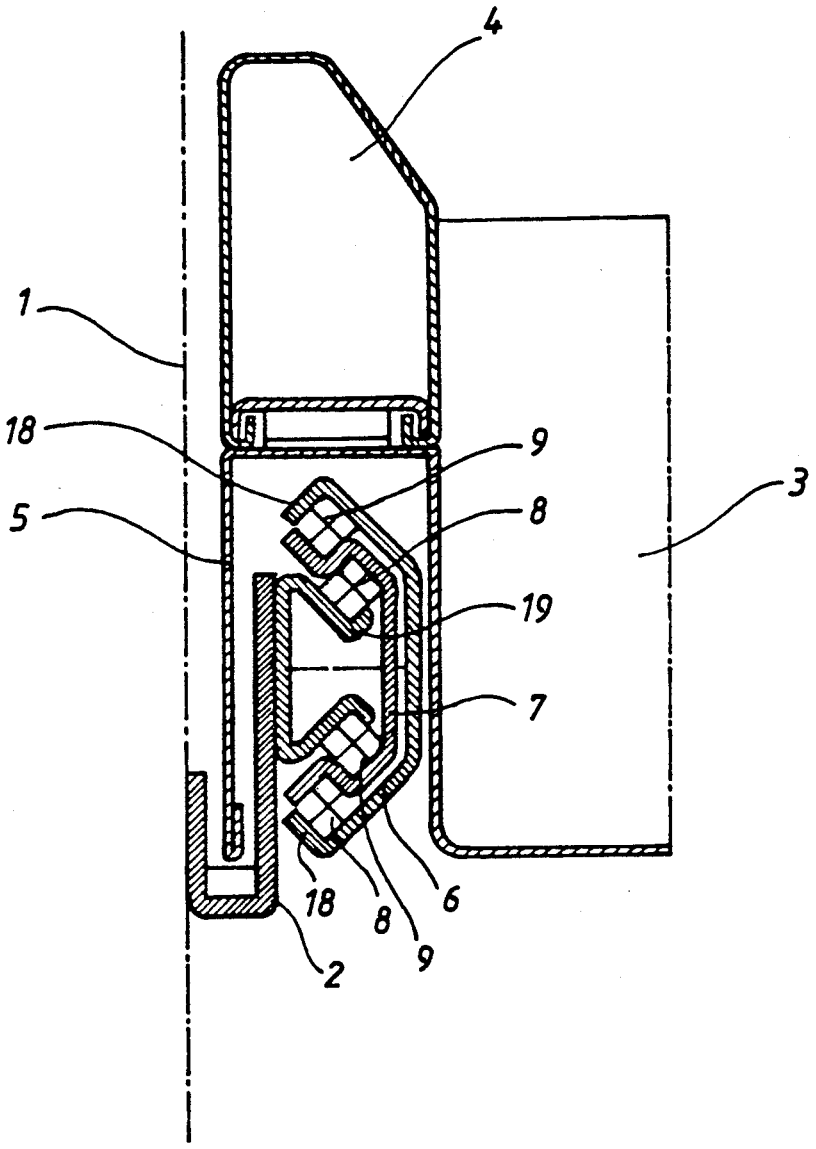
FIG. 1 is a section through a rolling element guide according to the invention as a covered type.
Figure 2:
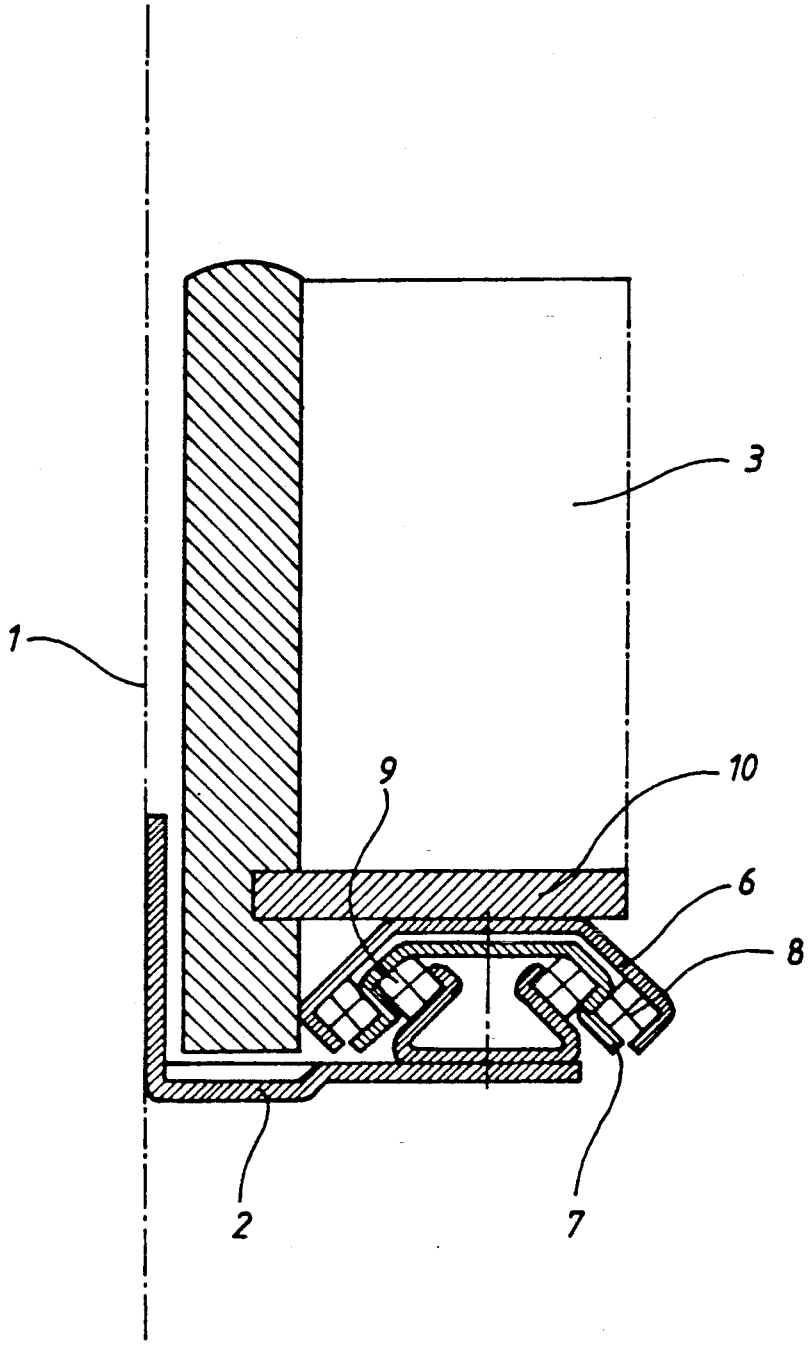
FIG. 2 is a section through a rolling element guide as an underlying guide.
Figure 3:
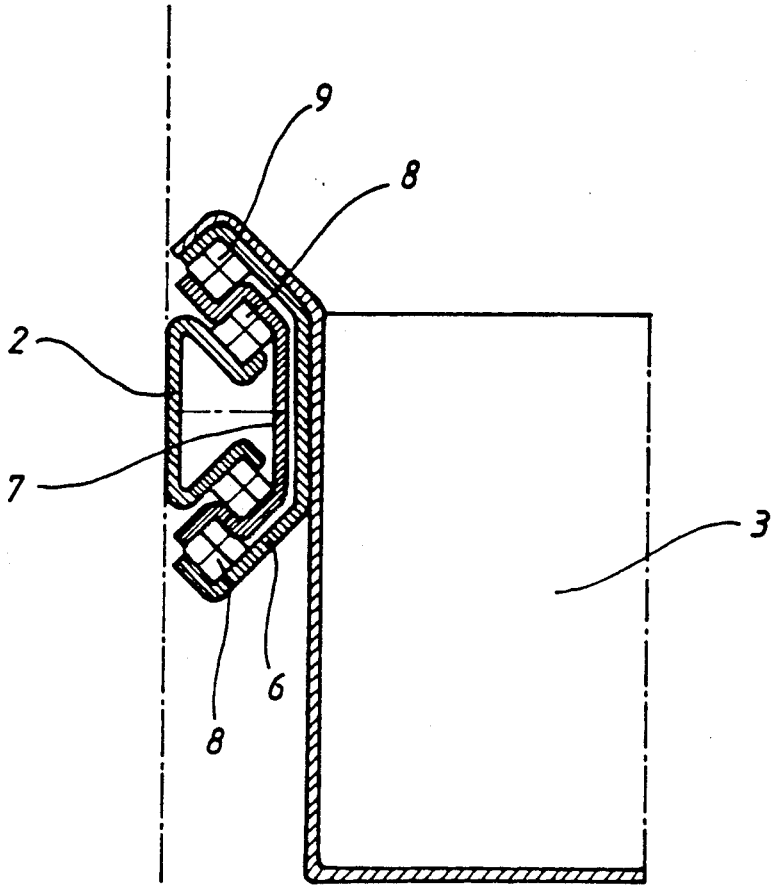
FIG. 3 is a section through a rolling element guide as a visible guide.

In FIGS. 1 to 3, a furniture unit body rail 2 is mounted on a furniture unit body side wall 1. Inner rolling elements 8 pivot in an inner roller cage 11 (cf. FIG. 6) and are braced on the one hand on rolling surfaces of the furniture unit body rail and, on the other hand, on rolling surfaces of an intermediate rail 7.

The furniture unit body rail 2 has an approximately U-shaped contour and has legs 19 directed outwardly at an angle of 45 degrees from the horizontal.

Arranged in the space between the intermediate rail 7 and the drawer rail 6 is a further roller cage 12 (cf. FIG. 6), which serves to hold the outer rolling element 9. The drawer rail 6 has an approximately C-shaped contour and has legs directed inwardly at an angle of 45 degrees from the horizontal.

The drawer 6 is mounted on the outer side of a drawer 3, which also has a covering sectional shape 4 at the outside and a leg 5 extending downwardly through the rolling element guide, so that the entire rolling element guide is not visible from the side when the drawer 3 is pulled out.

In FIG. 2, the previously described rolling element guide is shown in its design as a guide below the surface where the drawer rail 6 is mounted under a drawer base 10.

In FIG. 3, the same rolling element guide is designed as a guide visible from the side, the same parts being provided with the same reference symbols as in FIGS. 1 and 2.

FIGS. 3, 5 and 6 show that the rolling elements 8, which pivot in the roller cage 11, just as the rolling elements 9, which pivot in the roller cage 12, are staggered by 90 degrees with respect to each other.

In FIG. 6, the roller cages 11, 12 are represented only by dotted lines.

It can be seen in FIG. 5 relative to the two most forward rollers 9 of the roller cage 12, for example, that the pins 13 on the opposing end faces of the rolling element 9 form an axial direction 17 angled upward. This forms an angle 15 of 45 degrees, for example, in the direction of the horizontal line 16.

As a counter-move to this, it can be seen that the bottom rolling element 9 associated with the top rolling element forms an axial direction 17 of 45 degrees from the horizontal line 16 as well.

Figure 9:
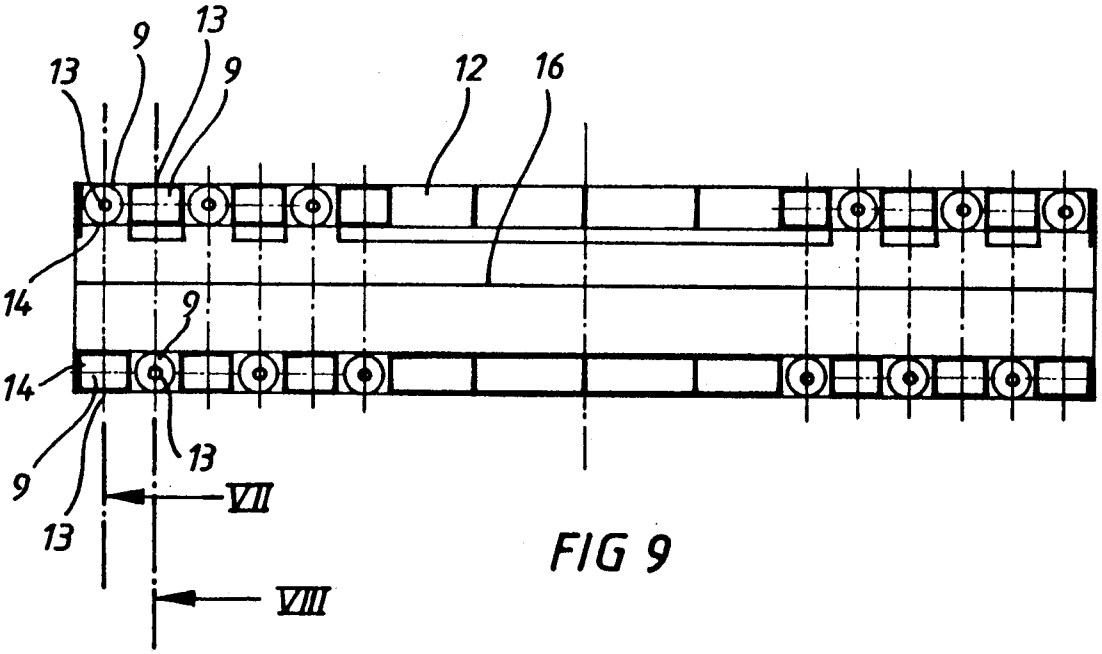
FIG. 9 is a side view of the roller cage.
Figure 8:
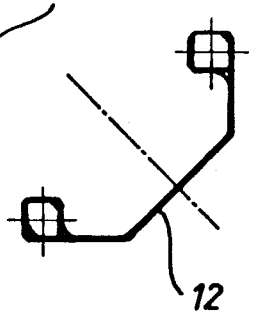
FIG. 8 is a section through the roller cage according to FIG. 9 along the line VIII.
Figure 7:
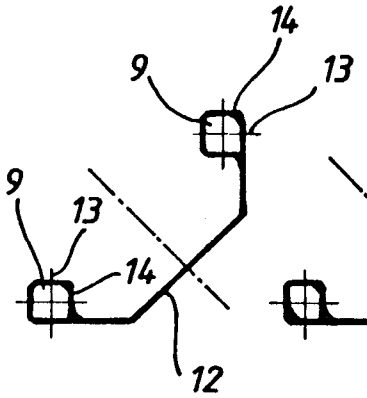
FIG. 7 is a section through a roller cage corresponding to the line VII in FIG. 9.

It can now be seen in FIG. 9 that the pins 13 are staggered 90 degrees with respect to each other. The rolling elements 9 in paired arrangement in FIG. 9 are thus staggered 90 degrees with respect to each other. Relative to the most forward rolling element 9, this means that the top rolling element 9 in FIG. 9 is, with its pin 13, vertical to the drawing plane of FIG. 9, while the rolling element 9 below is, with its pin 13, arranged in the drawing plane. This forms rolling surfaces 14 staggered 90 degrees with respect to each other relative to the rolling elements 9 or 8 arranged in pairs.

This results in a 90 degree staggered bracing of the rolling elements 8, 9 on the associated surfaces of the rails 2, 6, 7, which effects a favorable load transfer acting in all directions, while the rolling noise is considerably reduced at the same time.

Figure 10:
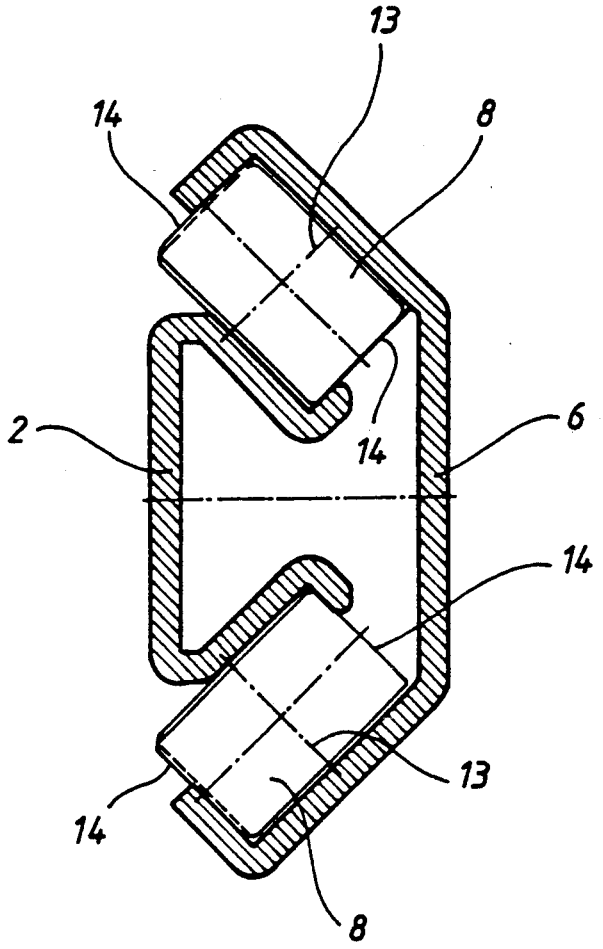
FIG. 10 is a section through a guide without roller cage.

FIG. 10 also shows that, instead of a telescoping pull-out using an intermediate rail 6, a guide can also be provided directly between a furniture unit body rail 2 and an associated drawer rail 6. In this case, only a single roller cage is provided.

What is claimed is:

1. Rolling element guide for drawer guides comprising a furniture unit body rail mounted on the furniture unit body side wall and a drawer rail mounted on the drawer, rolling surfaces for the rolling elements transmitting the drawer load being arranged on the two rails, said rolling elements being held in a roller cage that is arranged between the rails, characterized in that, on opposing end faces, the rolling elements have pins, which pivot in the roller cage, and in that the pins of the rolling elements in the same plane are staggered 90 degrees with respect to each other.

2. Rolling element guide as described in claim 1, characterized in that the axial direction of the pins form an angle of about 45 degrees with the center longitudinal axis of the roller cage.

3. Rolling element guide as described in claims 1, or 2, characterized in that the axial directions of the rolling elements arranged in the same plane in the roller cage together form an angle of 90 degrees.

4. Rolling element guide as described in one of claims 1 or 2, characterized in that an intermediate rail is arranged in the space between the furniture unit body rail and the drawer rail, and in that a first roller cage is arranged between the furniture unit body rail and the intermediate rail and a second roller cage is arranged between the intermediate rail and the drawer rail.

5. Rolling element guide as described in one of claims 1 or 2, characterized in that the rolling elements are designed as a roll or roller or as a cylindrical roller needle.

6. Rolling element guide as described in one of claims 1 or 2 characterized in that one of the drawer rail and the furniture unit body rail has approximately the shape of a C with legs, which are directed inward at an angle of 45 degrees and on the inner sides of which the rolling surfaces of the rolling elements roll, and in that the other of the drawer rail and the furniture unit body rail has approximately the shape of a U with legs, which are directed outward at an angle of 45 degrees and on the inner sides of which the rolling surfaces of the rolling elements roll.

7. Rolling element guide as described in claims 1 or 2, wherein the rolling elements are described as a spherical roller.

8. Rolling element guide as described in claims 1 or 2, wherein the rolling elements are described as a needle.

* * * * *